United States Patent [19]

Wachtel

[11] 4,445,070

[45] Apr. 24, 1984

[54] ELECTRON GUN FOR PRODUCING SPIRAL ELECTRON BEAMS AND GYROTRON DEVICES INCLUDING SAME

[75] Inventor: Jonathan M. Wachtel, Rechovot, Israel

[73] Assignee: Elta Electronics Industries Ltd., Ashdod, Israel

[21] Appl. No.: 320,838

[22] Filed: Nov. 12, 1981

[30] Foreign Application Priority Data

Dec. 18, 1980 [IL] Israel ..... 61759

[51] Int. Cl.[3] ..... H01J 25/00

[52] U.S. Cl. ..... 315/4; 313/430; 313/455; 315/5; 315/5.35

[58] Field of Search ..... 315/3, 4, 5, 5.35, 5.29; 313/430, 433, 455

[56] References Cited

U.S. PATENT DOCUMENTS

| | | | |
|---|---|---|---|
| 3,183,399 | 5/1965 | Pantell | 315/4 |
| 3,450,931 | 6/1969 | Feinstein et al. | 315/5.41 |
| 3,457,450 | 7/1969 | Feinstein et al. | 315/5 |
| 3,463,959 | 8/1969 | Jory et al. | 315/5.42 X |
| 3,916,239 | 10/1975 | Friedlander | 328/233 |
| 4,199,709 | 4/1980 | Alirot et al. | 315/4 |
| 4,224,576 | 9/1980 | Granatstein et al. | 315/5 |
| 4,253,068 | 2/1981 | Barnett | 315/3 |
| 4,370,621 | 1/1983 | Sprangle et al. | 315/5 |

*Primary Examiner*—Saxfield Chatmon, Jr.
*Attorney, Agent, or Firm*—Benjamin J. Barish

[57] ABSTRACT

An electron gun producing a spiral electron beam for gyrotron devices comprises means for producing an axial magnetic field propagating the beam axially beyond the anode of the electron gun, and separate electromagnets for producing a transverse "kicker" electromagnetic field beyond the anode and perpendicular to the magnetic propagation field such as to apply a transverse impulse of short duration, imparting a transverse motion, to the electrons to cause them to spiral as they are propagated axially beyond the anode.

10 Claims, 13 Drawing Figures

AF
EB
KF
X(cm)&TESLA
Z(cm)
0
1
2
3
4
5
6
7
-20
-15
-10
-5
0
5
10
15
20

AF
EB
KF
X(cm)&(TESLA)
Z(cm)
0
1
2
3
4
5
6
7
-20
-15
-10
-5
0
5
10
15
20

AF
EB
KF
X (cm) & TESLA
Z(cm)
.7
.6
.5
.4
.3
.2
.1
0
-20
-15
-10
-5
0
5
10
15
20

AF
EB
KF
X(cm) & (TESLA)
Z(cm)
.6
.5
.4
.3
.2
.1
0
-20
-15
-10
-5
0
5
10
15
20

AF
EB
KF
X(cm) &(TESLA)
Z(cm)
.7
.6
.5
.4
.3
.2
.1
0
-20
-15
-10
-5
0
5
10
15
20

AF
EB
KF
X(cm) &(TESLA)
Z (cm)
.7
.6
.5
.4
.3
.2
.1
0
-20
-15
-10
-5
0
5
10
15
20

ELECTRON GUN FOR PRODUCING SPIRAL ELECTRON BEAMS AND GYROTRON DEVICES INCLUDING SAME

BACKGROUND OF THE INVENTION

The present invention relates to electron guns for producing spiral electron beams, and also to gyrotron devices including such electron guns.

The gyrotron device, also called electron cyclotron maser, is a newly-developed, high-power millimeter-wave device which utilizes an electron gun producing a spiral electron beam. The millimeter-wave electro-magnetic radiations generated by this device result from the phase-bunching of the electrons which are rotated in a corkscrew motion about the lines of the axially-extending magnetic field. This device has been operated in several different configurations, including an oscillator configuration wherein the electron beam is propagated through a shaped cylindrical cavity, and a travelling-wave-amplifier configuration wherein the electron beam is propagated in a hollow pipe.

The method for producing the spiral electron beam used in the first scientific demonstration of the operation of the gyrotron is commonly called the "magnetic corkscrew" technique. This technique superimposes, on an axial magnetic field, a rotating magnetic field whose spatial rotation period is the same as the spatial rotation period of the electron beam. The latter period is determined by the rotational velocity of the electrons, which is in turn determined by the magnetic field and the drift or parallel velocity of the electrons. However, the "magnetic corckscrew" technique has not been used in the current generation of high power gyrotrons because it has critical adjustment problems and requires exact spatial resonance, a very long tube, and a specific shape of the magnetic field.

A second known method for producing the spiral beam is called the "cusp" technique. This technique generates the spiral electron beam by the injection of a linear beam off-axis into a cusp to produce a magnetic field having a radial component. However, this technique also suffers from the disadvantage of critical adjustment problems since the perpendicular component of the magnetic field cannot be adjusted independently of the axial component.

The method of producing spiral electron beams most commonly used today is called the "magnetron injection" technique. It operates on the principle of crossed electric and magnetic fields such that the beam is generated initially with a transverse component. Thus, the electric field extends between the cathode and the anode, and also between the cathode and a control electrode, so that it includes both an axial component and a radial component. The magnetic field is an axial one, so that as soon as the electrons leave the cathode, they experience a crossed electric and magnetic field producing the spiral motion of the electron beam.

While the "magnetron injection" technique is the most common method today of producing spiral electron beams for gyrotrons, this technique also requires that the values of the magnetic and electrical fields be very carefully controlled, to prevent the electron orbits from becoming unstable such that the electrons leaving the cathode may return to it. In addition, the magnetron injection gun has a relatively short useful life, for the following reasons:

Generally speaking, high power electron guns operating in the "temperature-limited condition" are usually short-lived because of the contamination of the cathode surface. For long life, the cathodes must generally operate in the "space-charge-limited condition," wherein there is a sufficiently dense cloud of electrons in front of the emitting surface that the predominant source of electrons becomes a cloud rather than the cathode surface itself. Since magnetron injection guns require critical adjustment of the electric field, and since the electric field becomes unpredictable when there is a strong space charge, these guns are generally operated in the "temperature-limited condition", and therefore their lifetime is quite short, being in the tens or at most hundreds of hours. Such guns, therefore, have a very short useful life when compared to electron guns operating in the space-charge limited condition which commonly have lifetimes in the thousands of hours.

An object of the present invention is to provide a novel electron gun for producing a spiral beam which gun has advantages over the known types described above. Another object of the invention is to provide a gyrotron including the novel electron gun.

BRIEF SUMMARY OF THE INVENTION

According to a broad aspect of the present invention, there is provided an electron gun producing a spiral electron beam, including a cathode for providing a source of electrons, an apertured anode for drawing the electrons therethrough in the form of a beam, and means for imparting a spiral motion to said beam drawn through the anode; characterized in that said latter means comprises: (1) axial-field producing means for producing an axial magnetic field propagating the beam axially beyond the anode, and (2) separate transverse-field producing means for producing a transverse "kicker" electro-magnetic field beyond the anode and perpendicular to the magnetic propagation field such as to apply a transverse impulse of short duration, imparting a transverse motion, to the electrons to cause them to spiral as they are propagated axially beyond the anode.

More particularly, and as present in the described preferred embodiment, the "kicker" field applies said transverse impulse to the electrons for a period of time less than that required to produce a complete rotation, preferably less than that required to produce a half rotation, of the electrons within the spiral beam.

It is thus seen that the present invention operates according to a technique, which can be called the "kicker" technique, in which the rotational motion of the electrons is effected by a transverse kick or bump applied to them as they pass through the "kicker" field. Thus, the acceleration process for accelerating the electrons axially is separated from the rotation process which produces the perpendicular momentum or rotation of the electrons. Because of this separation, it is possible not only to independently adjust the perpendicular and axial forces to provide close control of the produced spiral electron beam, but it is also possible to use the Pierce-type electron gun, which is a gun operating at very high power, in the many kilowatts, in a space-charge-limited condition to provide many thousands of hours of useful life.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

Figure 1:
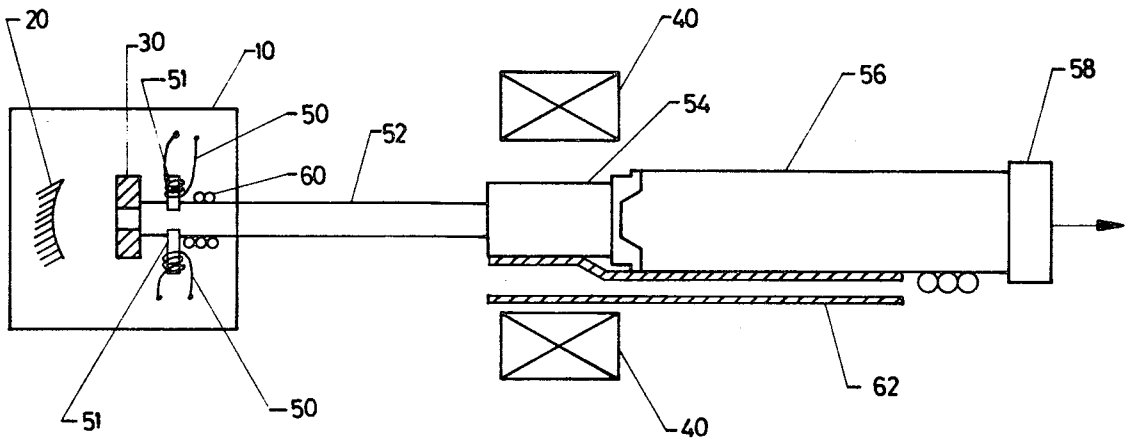
FIG. 1 is a diagrammatic view illustrating one form of gyrotron including an electron gun constructed in accordance with the present invention to produce a spiral beam.

The gyrotron diagrammatically illustrated in FIG. 1 is configured to operate as an oscillator. Broadly speaking, it includes an electron gun, generally designated 10, comprising a cathode 20 providing a source of electrons, and an apertured anode 30 through which the electrons are drawn in the form of a beam by means of an axial magnetic field produced by an axial-field coil 40. As known in gyrotrons, the latter coil should produce an axial magnetic field high enough to confine and collimate the beam as it emerges from the anode 30.

Electron gun 10 further includes transverse-field coils 50 having pole-pieces 51 producing a transverse magnetic field beyond the anode 30 and perpendicular to the magnetic propagation field of magnetic coils 40. The latter coils 50 apply a transverse "kick", or impulse of short duration, to the electrons to cause them to spiral as they are propagated axially beyond the anode. The transverse impulse applied by the "kicker" field should be for a short period of time, less than that required to produce a complete, preferably less than a half, rotation of the electrons within the spiral beam.

The spiral beam thus produced is propagated through a drift tube 52 and then through a shaped cylindrical cavity 54, which defines the gyrotron interaction region in the oscillator configuration of the gyrotron. The radiations produced by the gyrotron are outputted via a waveguide 56 and an output window 58.

While FIG. 1 illustrates an oscillator configuration of the gyrotron, it will be appreciated that this is shown merely for purposes of example. Thus, if the gyrotron is to be configured to operate as a travelling-wave amplifier, the interaction region through which the spiral electron beam is propagated would be a hollow pipe or waveguide, instead of the cylindrical cavity 54.

Electron gun 10 is basically of the well-known Pierce type, except for the modifications to include the transverse "kicker" field as will be described more particularly below. The construction of electron gun 10 is more particularly illustrated in FIG. 2.

Figure 2:
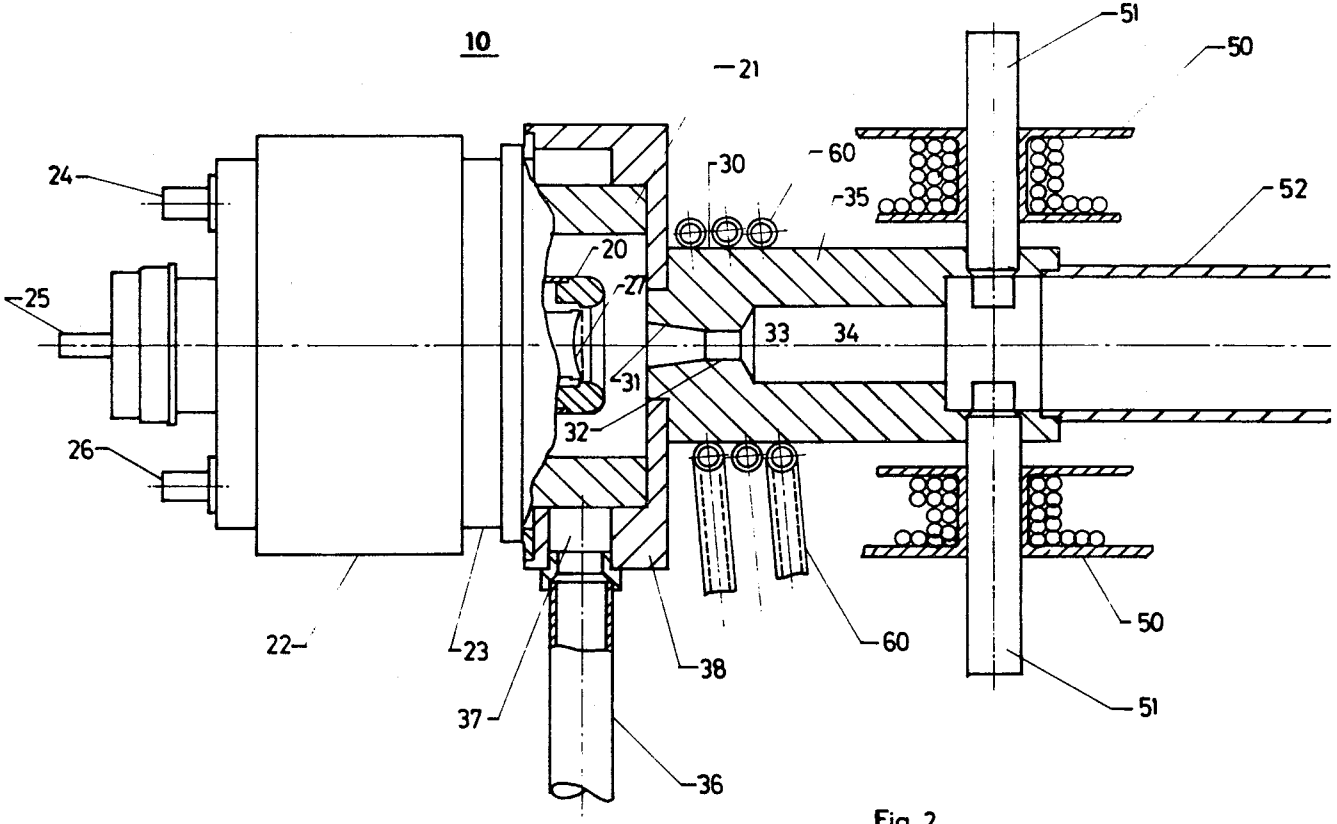
FIG. 2 is an enlarged view of the electron gun of FIG. 1.

As shown in FIG. 2, the cathode 20 is of the indirectly-heated type and is enclosed within a magnetic shield 21, e.g., of steel, bonded to a ceramic insulator 22 via a ceramic-to-metal bond 23. The electrical connections to the cathode 20 and its heating element (not shown) are made via electrical terminals 24, 25 and 26 through the ceramic insulator body 22. As in the well-known Pierce-gun, the cathode 20 includes a spherical surface 27 which emits a solid beam of electrons, rather than a narrow annular ring emitting a hollow beam of electrons as in the type used in the conventional magnetron-type injection gun.

Anode 30 is of metal (e.g., copper) formed with an axial bore therethrough aligned with the axis of the cathode 20. The axial bore through anode 30 is shaped so as to provide a conical entrance 31 of decreasing diameter, a waist 32 of substantially uniform diameter, and a conical outlet 33 of increasing diameter. The latter leads to an enlarged bore section 34 defining an axial extension 35 of the anode 30.

Evacuation of the gyrotron is effected by means of a tube 36 connected to a vacuum pump (not shown), the tube leading to a passageway 37 formed in the outer magnetic shield 38 of the electron gun, which passageway communicates with the interior of the electron gun. Cooling of the gyrotron is effected by a jacket or pipe 60 for a cooling fluid (e.g., water) coiled around the outer face of the anode 30, and by another water-jacket or U-tube 62 applied to the outer wall (the lower side in FIG. 1) of the output waveguide 56. Since the electrons flow off-axis through the cavity 54, they fall against the inner wall of the output waveguide on one side of the axis. The output window 58 is thus protected against damage by electron beam impact.

The electron flow from the cathode 20 is focused from its spherical surface 27 through the waist 32 of anode 30 and emerges in the form of a linear pencil beam. The diameter of the electron beam is somewhat less than the diameter of the waist 32 of the anode aperture. As indicated earlier, this beam is propagated axially through bore 34 of the anode extension to the gyrotron cavity (54, FIG. 1) by means of the axial magnetic field produced by the field magnet coil 40.

The "kicker" magnetic field, which applies a transverse impulse or "kick" to the electrons in the beam, is produced by the "kicker" field coils 50 and the two diametrically-opposed pole pieces 51 enclosed by the coils. The pole pieces 51 are received in diametrically-opposed openings formed in extension 35 of the anode 30, and are aligned with each other so as to be perpendicular to the longitudinal axis of the anode through which the electron beam is propagated.

It will thus be seen that the "kicker" magnetic field, produced by the "kicker" magnets 50 and pole pieces 51, is superimposed on, and is perpendicular to, the axial magnetic field produced by the axial field coils 40. Thus, if a magnetic field line of force is traced through the gun, the magnetic field line which begins on the gun axis will progress in the form of a straight line along that axis until it arrives at the kicker field produced by magnets 50, whereupon the field line will be displaced outwardly, and will then proceed as a straight line through the remainder of the tube.

Accordingly, as an electron enters this "kicker" region, it receives a transverse kick or bump and immediately goes into rotational motion. This rotational motion can be controlled by controlling the relative magnitudes of the axial magnetic field produced by magnet 40, and the perpendicular kicker field produced by magnet 50. This arrangement thus permits convenient control of the division of the original energy, between rotation (transverse motion) and drift (axial motion), acquired by the electrons in the gun.

More particularly, this arrangement permits convenient control of the value "$\alpha$", which is the ratio of the perpendicular or transverse velocity of the electrons, to the parallel or axial velocity (i.e., $\alpha = v_T/v_A$). Preferably, the value of "$\alpha$" should be between 1.5 and 3. The described arrangement including the kicker field permits this range of "$\alpha$" to be achieved with practical design dimensions.

As one example, the construction illustrated in FIGS. 1 and 2 was operated with a Pierce-type gun at a voltage of 9 kV and at a current of 650 mA. The axial magnetic field in the region of the gun was approximately 1,200 Gauss, which field, since it was produced by the fringing field of a single coil (40) downstream of the gun, increased in the direction of propagation of the electron beam. The kicker magnetic field was then turned on, and sufficient transverse motion was imparted to the beam to cause complete spiralling of the beam to the point where there was no longer any drift motion, but rather reversal of propagation of the beam. In this experiment, the kicker field was between 200 and 400 Gauss at the turn-around point; the spacing between the pole pieces 51 was 9 mm, and their diameters were approximately 5 mm. The diameter of the electron beam injected between these pole pieces was approximately 3 mm.

FIGS. 3*a*–3*f* are computer simulations of the motion of an electron in the field configuration of the kicker gun system illustrated in FIGS. 1 and 2. In these graphs, curve AF illustrates the axial magnetic field produced by the axial field magnet 40, and the small bump represented by curve KF illustrates the kicker field produced by the kicker magnets 50 and pole pieces 51 which impart the transverse impulse of short duration to produce the rotary motion in the electrons. The axial magnetic field (curve AF) is 6,000 Gauss peak in all the computer simulations, and the "0" centimeter mark along the Z-axis is the central point where the gyrotron interaction would take place, this being the center of the gyrotron cavity 54 (FIG. 1) in the illustrated embodiment. The gyrotron is operated as a 16 gHz oscillator in which the cathode-anode voltage ($E_K$) equals 8 kV.

Figure 3B:
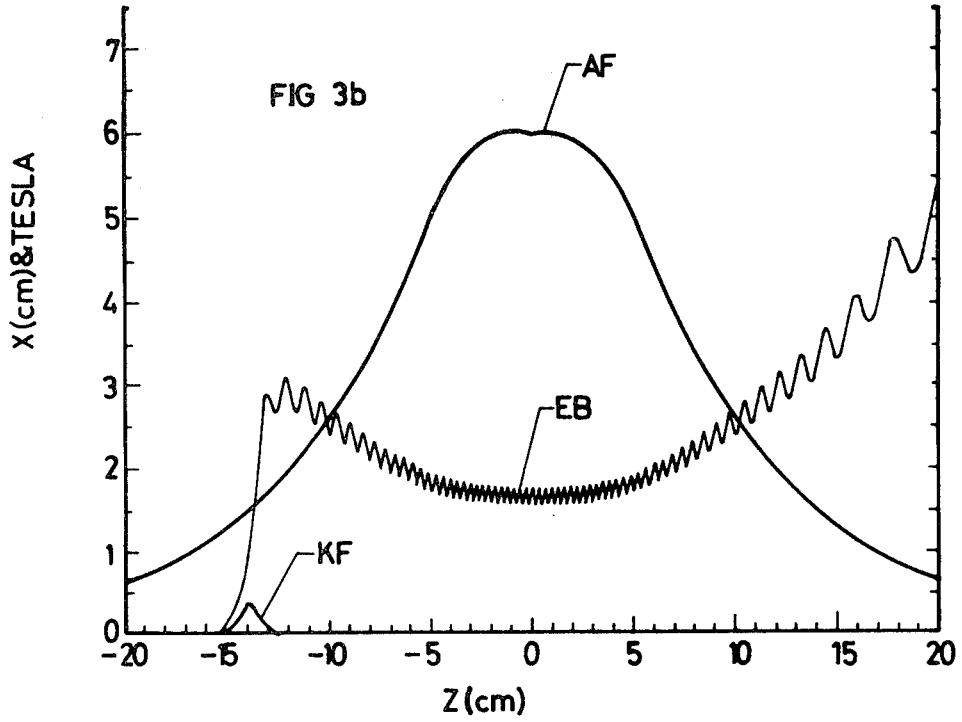
FIGS. 3*a*–3*f* are diagrams representing computer simulations of the motion of an electron in the field of the electron gun system illustrated in FIG. 2, under different strengths and different positions of the "kicker" field.
Figure 3A:
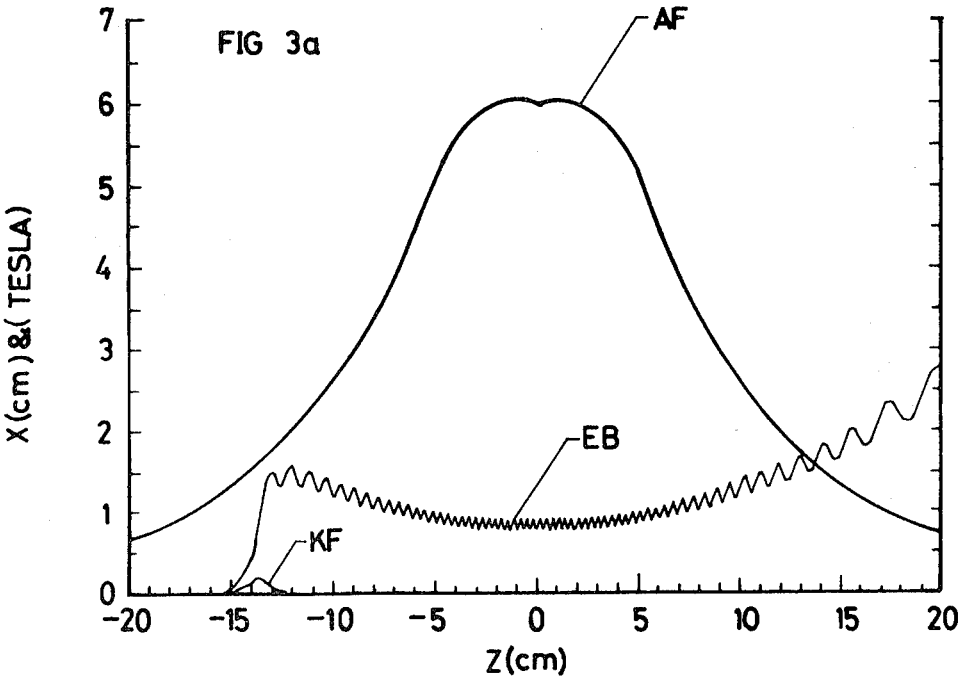

FIG. 3*a* illustrates the arrangement wherein the kicker field is located 13.5 centimeters from the "0" point and has a field strength of 200 Gauss, wherein it will be seen that a small amount of transverse momentum or rotational energy is imparted to the beam. This produces an "$\alpha$" of about 0.14, which is far below the optimum range of 1.5–3.

The remaining FIGS. 3*b*–3*f* illustrate how the transverse impulse imparted to the electrons may be varied by changing not only the strength of the kicker transverse field, but also its location with respect to the axial magnetic field.

Figure 3C:
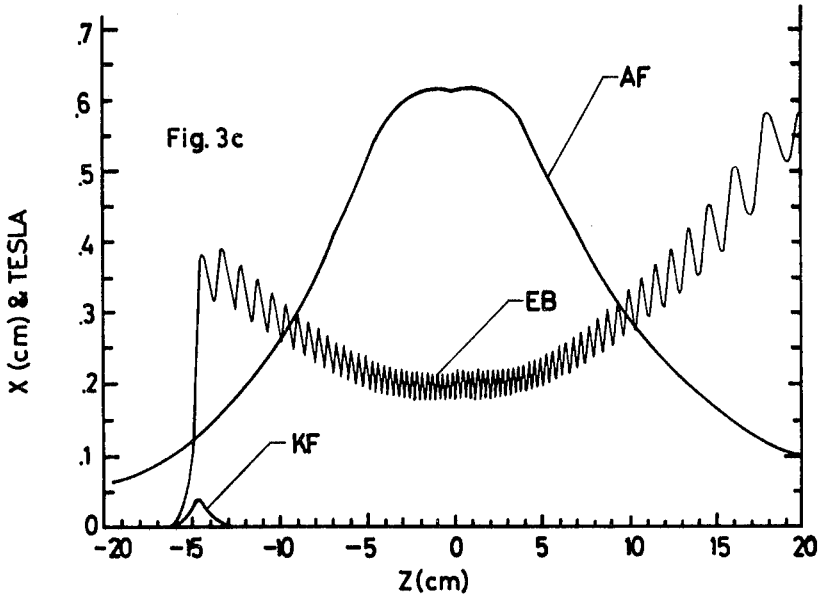
Figure 3D:
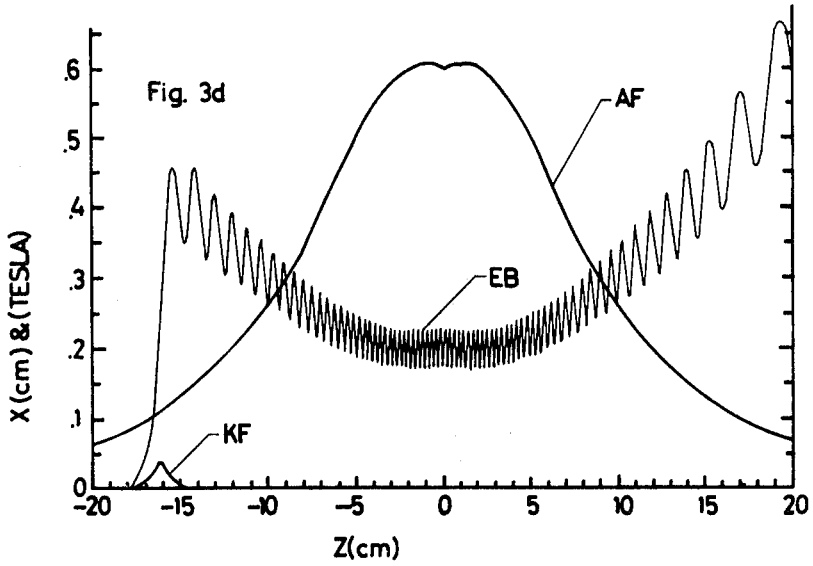
Figure 3E:
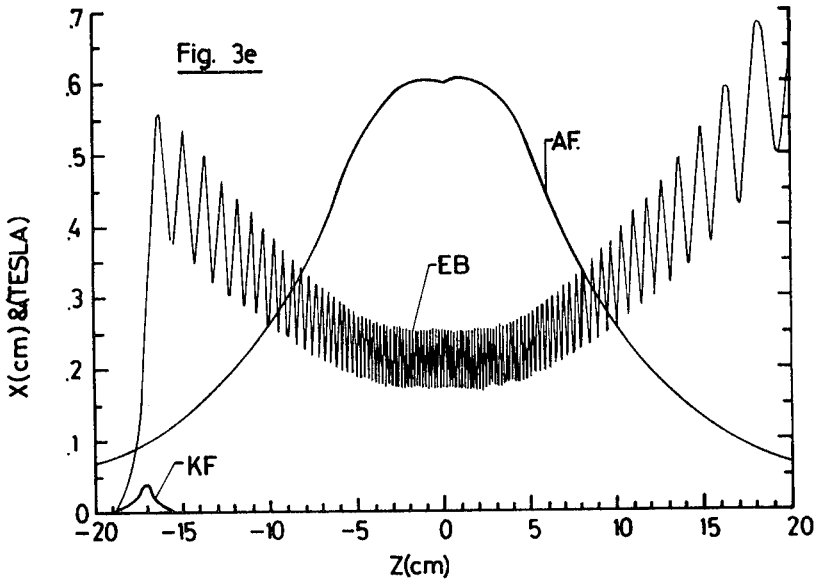
Figure 3F:
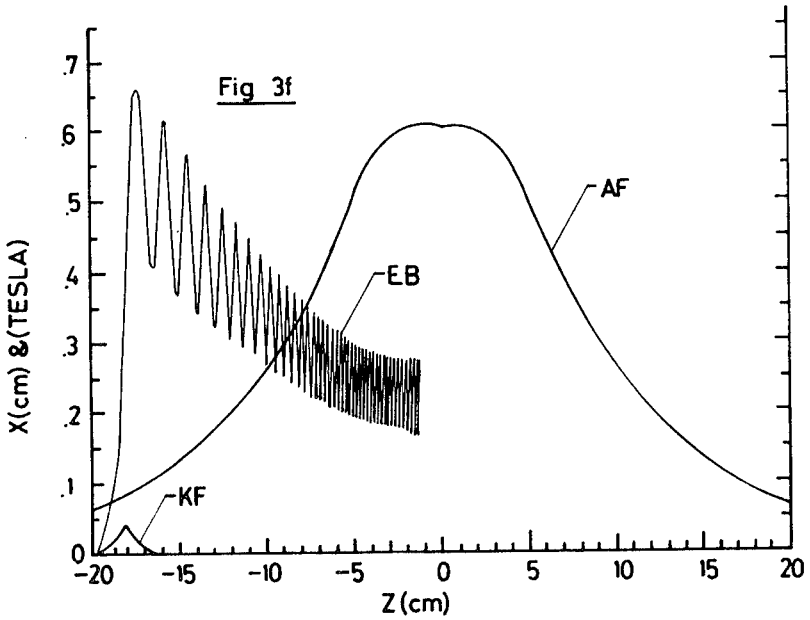

Thus, as shown in FIG. 3*b*, the kicker field is increased to 400 Gauss, which thereby increases the radius of its circular motion, to produce an "$\alpha$" of 0.23: this is still far below the optimum range of 1.5–3. In FIG. 3*c*, the kicker field, still of 400 Gauss, is moved to the 15 cm point, which increases the "$\alpha$" to 0.43, and FIG. 3*d* illustrates the kicker field moved to the 16 cm point which increases the "$\alpha$" to 0.67, both still being below the preferred range of 1.5–3. However, in FIG. 3*e*, the kicker field, still of 400 Gauss, is moved to the 17 cm point, wherein it will be seen that "$\alpha$" is increased to 1.55, which is within the preferred range of 1.5–3. Finally, FIG. 3*f* illustrates the conditions wherein the kicker field is moved to the 18 cm point, and although still of 400 Gauss, produces an "$\alpha$" of infinity. That is to say, the transverse impulse applied to the electrons produces so much rotational motion that the electron ultimately stops before it reaches the maximum value of the axial magnetic field, and therefore returns to its original path back to the electron gun.

While the computer simulations of FIGS. 3*a*–3*f* illustrate that the division of energy between transverse motion and axial motion can be carefully controlled by adjusting both the strength and the location of the transverse kicker magnetic field, the most convenient control would be by adjusting the strength of the kicker field by controlling the current through the field coils 50.

As indicated earlier, the "kick" applied by the transverse magnetic field (magnet 50 and pole pieces 51) should be of very short duration to impart the transverse motion to the electrons, and thereby to cause them to spiral as they are propagated axially beyond the anode. Preferably, the transverse impulse applied to the electrons should be for a period of time less than that required to produce a one-half rotation of the electrons while they are in the transverse magnetic field. The actual length of the transverse magnetic field is determined by the dimensions of the pole pieces 50, and the electron velocity determines how long the electrons remain in this region.

It will be appreciated that the technique of producing a spiral electron beam by the method described herein, using an external kicker field, differs substantially from the method of producing a spiral beam in the conventional magnetron injection gun. The basic differences will be readily apparent by a comparison of FIG. 4*a*, illustratihg the manner of producing a spiral beam in the conventional magnetron injection gun, with FIG. 4*b* illustrating the "kicker" technique for producing a spiral beam in the above-described gyrotron constructed in accordance with the present invention.

Figure 4A:
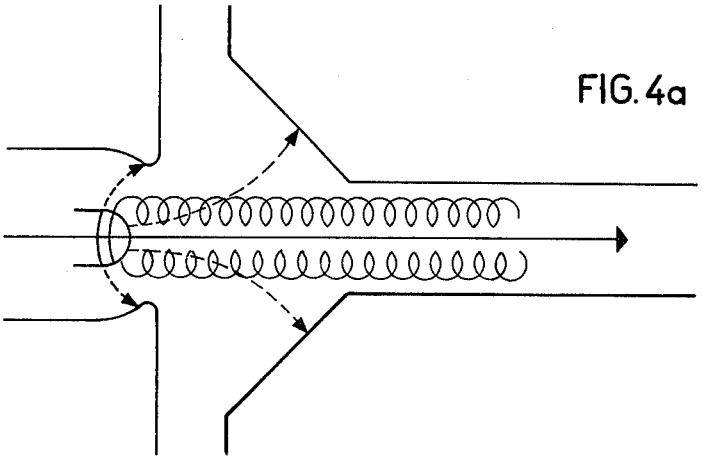
FIG. 4a (PRIOR ART)
FIGS. 4*a* and 4*b* are diagrams respectively illustrating the manner of producing a spiral beam in the known magnetron injection gun and the manner of producing the spiral beam using the "kicker" technique of the present invention.
Figure 4B:
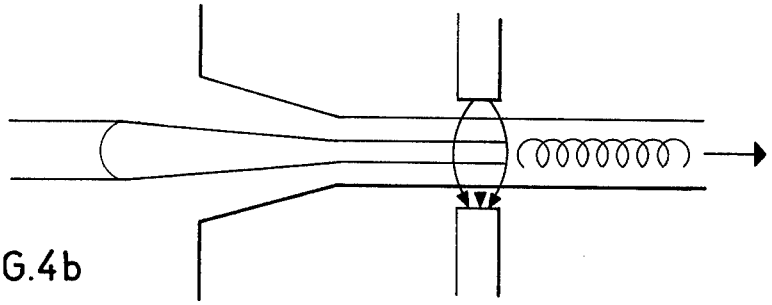

One important difference is that in the hereindescribed "kicker technique" of the present invention (FIG. 4*b*), the mechanism for effecting the transverse movement of the electrons to impart the rotational motion is separate and distinct from that for effecting the axial acceleration of the electron beam, which is not the case in the magnetron injection gun (FIG. 4*a*).

In addition, the rotational motion in the "kicker technique" (FIG. 4*b*) is effected only by the kicker magnetic field, whereas in the magnetron injection gun (FIG. 4*a*) it is a complicated function of both the electric and magnetic fields. Accordingly, in the "kicker technique", the amount of current drawn into the beam is not affected by the control of the perpendicular force that is applied to the beam. This is to be contrasted with the magnetron injection gun wherein the electrode potentials in the magnetic field are inter-dependent and therefore one affects the other, thereby not only complicating the adjustment procedures, but also restricting the adjustment possibilities.

The independent-adjustment advantage of the hereindescribed kicker field technique, which permits the amount of perpendicular energy in the electron beam to be independently adjusted, is very useful in various gyrotron operations, for example, in tuning the frequency of a gyrotron amplifier or of a backward wave oscillator, in adjusting for thresholds to start oscillation conditions in oscillators, or in designing with parameters to achieve maximum efficiency by external electronic adjustment.

Further, by permitting the use of a Pierce-type electron gun operating in a space-charged limited region, the "kicker technique" of the present invention provides a long-life electron gun having the capability of producing a high intensity electron beam with high space charge, high density, and high power.

A further advantage of the described technique is that it enables attaining almost any desired value of "$\alpha$", up to infinity. An advantage of higher values of "$\alpha$" is that it permits the design of devices having higher gain and higher efficiency. The preferred range of "$\alpha$" is between 1.5–3, which is easily attainable in the novel technique as described above, as compared to the magnetron injection gun technique wherein "$\alpha$" values of over 1.5–1.8 have not yet been achieved, from the published literature.

Figure 5:
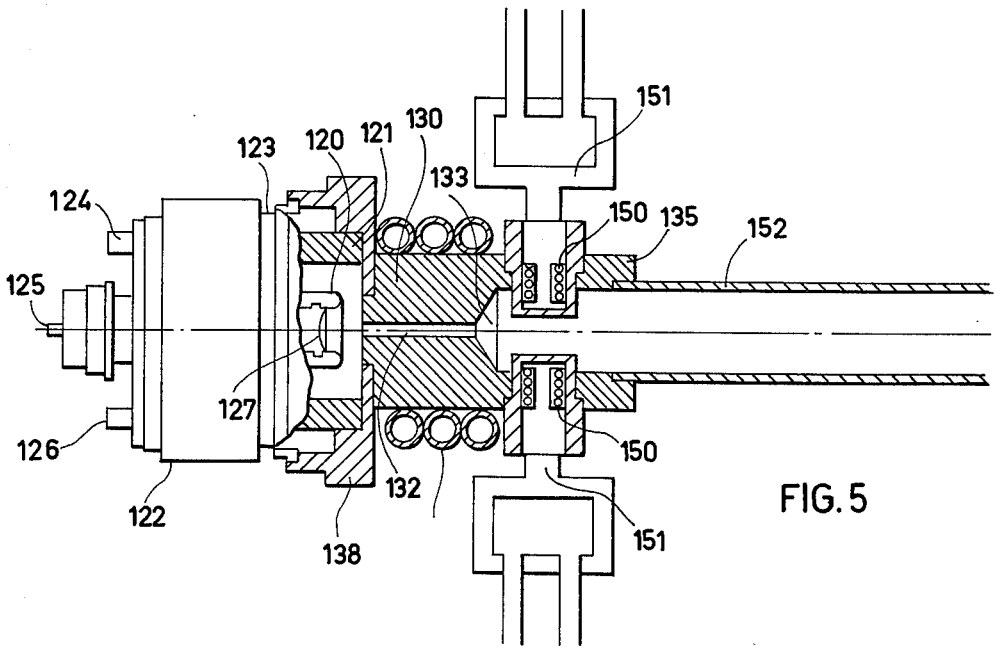
FIG. 5 illustrates a modified electron gun constructed in accordance with the present invention similar to that of FIG. 2 but including, among other modifications, cooling cores for the magnets instead of pole pieces.

FIG. 5 illustrates a modified electron gun structure, therein designated 110, for a gyrotron constructed in accordance with the present invention. In this modification, the transverse field coils 150, applying the transverse "kick" or impulse or short duration to the electrons to cause them to spiral as they are propagated axially beyond the anode 130, are not provided with pole pieces, corresponding to pole pieces 51 in FIG. 2, but rather are provided with cooling cores 151 having a heat-conducting fluid flowing therethrough, e.g., water-cooled cores of copper, for cooling the "kicker" coils 150. In addition, the axial bore 132 through the anode 130 is of slightly different configuration than in FIG. 2, having a narrow uniform diameter for substantially its complete length and a conical outlet 133 of increasing diameter just ahead of the "kicker" coils 150. The remaining elements of the electron gun in FIG. 5 are substantially the same as in the FIG. 2 construction, and are therefore correspondingly numbered except raised by "100", these elements including the cathode 120 providing the source of electrons, the magnetic shield 121 bonded to the ceramic insulator 122 via a ceramic-to-metal bond 123, the electrical connections 124, 125 and 126 to the cathode 120 and its heating element (not shown), the spherical surface 127 of the cathode emitting the solid beam of electrons, the annular extension 135 of the anode 130, the drift tube 152 through which the spiral beam is propagated, and the water cooled jacket 160 for cooling the anode 130.

Detailed computer simulations have shown that the "kicker" coil electron gun illustrated in FIG. 5 also produces a spiral beam suitable for use in a gyrotron tube. An example for a gyrotron oscillator operated at 16.5 GHz was calculated. The axial magnetic field in the cavity was 6000 Gauss, the beam voltage was 10 Kilovolts, and the "kicker" magnetic coils 150 were located at a point between the anode and the cavity wherein the axial magnetic field was 650 Gauss.

The small amount of rotational momentum applied to the electrons by the "kicker" field increases as the electrons spiral into the stronger magnetic field region. Once the electrons reach the cavity they are moving slowly in the axial direction with most of their energy in rotational motion. As indicated earlier, the part of the energy in rotational motion is characterized by the value "$\alpha$", this value representing the ratio of transverse velocity to axial velocity of the spirally-moving electrons.

Figure 6A:
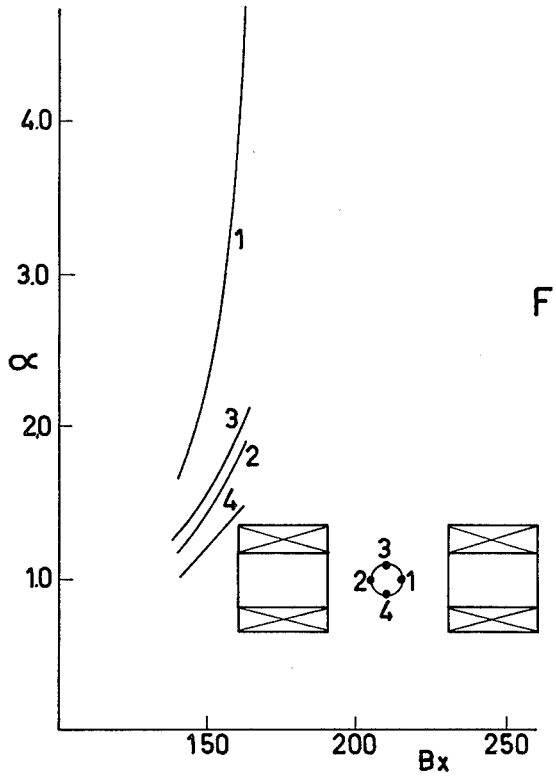
FIGS. 6*a* and 6*b* are diagrams illustrating the operation of the electron gun of FIG. 5.
Figure 6B:
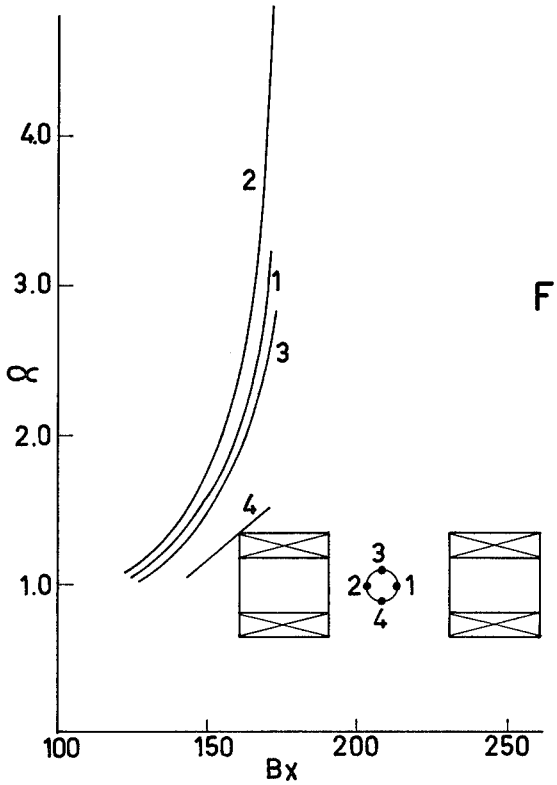

FIGS. 6*a* and 6*b* illustrate the value of "$\alpha$" achieved in the cavity by electrons that enter the "kicker" magnetic field at various points on the outer diameter of the beam. The beam diameter at the entry point is 2 mm, and the separation between the ends of the "kicker" electromagnetic coil 150 is 8 mm. The coil dimensions and locations are as shown in FIGS. 6*a* and 6*b*. A range of "$\alpha$" between 1.5 and 3.5 is achieved for values of the "kicker" magnetic field in the neighborhood of 160 Gauss.

A large current must be passed through small diameter wire in the coils 150 in order to achieve a field of 160 Gauss using small solenoid coils without permeable material. Coils have been tested corresponding to the computed design, namely of 7 mm diameter, 6 mm length, and containing 48 turns of 0.4 mm diameter copper magnetic wire with high temperature insulation. The coils were wound on a water-cooled copper spindle and the turns were potted with silver-loaded expoxy resin for high heat conductivity. Currents as high as 22 amperes have been sustained for more than one hour with water cooling of the spindle core.

While the invention has been described with respect to spiral-beam-producing guns for gyrotron devices, it will be appreciated that it could be used in other applications as well, for example in free-electron lasers requiring a spiral beam.

Other variations, modifications and applications of the invention will be apparent.

What is claimed is:

1. An electron gun producing a spiral electron beam, including a cathode providing a source of electrons, an apertured anode for drawing the electrons therethrough in the form of a beam, and means for imparting a spiral motion to said beam drawn through the anode; characterized in that said latter means comprises:

(1) axial field-producing means for producing an axial magnetic field propagating the beam axially beyond the anode, and (2) separate transverse field-producing means for producing a transverse "kicker" field beyond the anode and perpendicular to the magnetic propagation field such as to apply a transverse impulse of short duration, imparting a transverse motion, to the electrons to cause them to spiral as they are propagated axially beyond the anode; said "kicker" field applying said transverse impulse to the electrons for a period of time less than that required to produce a complete rotation of the electrons within the spiral beam.

2. The electron gun according to claim 1, wherein said "kicker" field applies said transverse impulse to the electrons for a period of time less than that required to produce a half rotation of the electrons within the spiral beam.

3. The electron gun according to claim 1, wherein said cathode includes a spherical surface emitting a solid beam of electrons.

4. The electron gun according to claim 1, wherein said "kicker" field is produced by electromagnets located behind the apertured anode and extending perpendicular to the longitudinal axis therethrough.

5. The electron gun according to claim 4, wherein said apertured anode is provided with a cylindrical extension at its outlet end, said electromagnets being received in diametrically-opposed openings formed in said extension.

6. The electron gun according to claim 1, wherein the aperture of said anode is shaped to provide a conical outlet.

7. The electron gun according to claim 6, wherein said aperture of the anode is shaped to further provide a waist of substantially uniform diameter joining its entrance to its conical outlet.

8. The electron gun according to claim 4, wherein said electromagnets are cooled by cooling cores having a heat-conducting fluid flowing therethrough.

9. The electron gun according to claim 1, wherein the transverse "kicker" field is of such magnitude and location, with respect to the axial magnetic field, to produce a ratio of transverse velocity to axial velocity ("$\alpha$") of 1.5 to 3.

10. A gyrotron including an electron gun as defined in claim 1 for producing a spiral electron beam therein, a drift tube through which the spiral beam is propagated, and a waveguide having an output window.

* * * * *